US005904096A

United States Patent [19]

Fawcett et al.

[11] Patent Number: 5,904,096

[45] Date of Patent: May 18, 1999

[54] MAGNETIC HOLDING DEVICE

[76] Inventors: Alan John Fawcett, Glenorie; Robert Miner, Collaroy Plateau, both of Australia

[21] Appl. No.: 08/427,968

[22] Filed: Apr. 26, 1995

[30] Foreign Application Priority Data

Apr. 26, 1994 [AU] Australia ..... PM5278

[51] Int. Cl.[6] ..... B41F 27/00

[52] U.S. Cl. ..... 101/389.1; 335/285; 269/8

[58] Field of Search ..... 335/285–295; 101/389.1; 269/8; 40/621, 711

[56] References Cited

U.S. PATENT DOCUMENTS

| | | | |
|---|---|---|---|
| 2,435,735 | 2/1948 | Briggs | 335/285 |
| 3,110,847 | 11/1963 | Ott et al. | 335/285 |
| 3,723,928 | 3/1973 | Blakey et al. | 335/285 |
| 4,468,648 | 8/1984 | Uchikune | 335/295 |

FOREIGN PATENT DOCUMENTS

| | | |
|---|---|---|
| 12218/76 | 9/1977 | Australia . |
| 51195/93 | 3/1994 | Australia . |
| 2152861 | 8/1985 | United Kingdom . |

*Primary Examiner*—Michael L. Gellner
*Assistant Examiner*—Raymond Barrera
*Attorney, Agent, or Firm*—Foley, Hoag & Eliot LLP

[57] ABSTRACT

A magnetic holding device comprises a housing (2) and includes a number of magnetic regions. Each magnetic region has a rare earth or bimetallic disc magnet (9) and a ferromagnetic plate (10) located within an aperture within the housing (2). A filling material (11) surrounds both the magnet (9) and disc (10).

16 Claims, 2 Drawing Sheets

MAGNETIC HOLDING DEVICE

This invention relates to magnetic holding devices, and in particular relates to magnetic holding devices used in the field of graphic arts, such as foil stamping.

Foil stamping is the process of transferring an ornamental design of thin metal foil or leaf to paper, card, plastic or similar media. The transfer of the foil is carried out under the action of heat and pressure. One of the conventional methods of foil stamping uses a plate of magnesium, or similar material, bearing the ornamental design in relief on one surface. This plate is directly mounted on a heating element, with a layer of foil positioned over the relieved surface, followed by the paper or other media to which the foil is to be applied. A pressure plate, located above the paper, is moved relative to the heating element to bring the two together, and the combination of heat and pressure binds the foil to the paper in the shape of the ornamental design.

Recent developments in the art of foil stamping have produced a substitute for the relieved magnesium plate in the form of a steel backed photopolymer plate, such as that produced by TOK Corporation of Japan. The photopolymer plate has several advantages over the magnesium plates, including producing a commercial finish and being less environmentally damaging to use, and can be used with conventional foil stamping equipment. This has led to steel backed photopolymer plates being preferred for foil stamping.

Some existing foil stamping equipment is designed to operate with the relieved surface at a fixed predetermined distance from the heating element. As photopolymer plates are thinner than conventional magnesium plates, the photopolymer plates need to be attached to the heating element by a means that will space the photopolymer plates from the heating element, yet still conduct heat from that element, so that the existing foil stamping equipment will not need to be modified in any way. Several disadvantages have become evident in the conventional methods and devices used to attach steel backed photopolymer plates.

It is an object of the invention to overcome or substantially ameliorate the above disadvantages.

There is disclosed herein a magnetic holding device for attaching a steel backed photopolymer plate to foil stamping equipment, said magnetic holding device comprising:

a planar member adapted for mounting on said foil stamping equipment and having a flat attachment surface; and one or more magnetic regions, each comprising means for providing a magnetic field attached to said planar member, said magnetic region(s) being adapted to removably secure said photopolymer plate against said planar member attachment surface.

BACKGROUND OF THE INVENTION

1. Field of the Invention

It is preferred that said magnetic field providing means comprise a permanent magnet. Alternatively, said magnetic field providing means may comprise an electromagnet.

2. Description of Related Arts; and

It is preferred that each magnetic field providing means be disc shaped and be mounted within a hole. It is further preferred that:

each hole have a first portion adjacent said attachment surface with a first diameter and a second portion with a second diameter greater than said first diameter;

a plate of steel or other ferrous material be disposed within said second portion of said hole, the size and shape of said plate preventing said plate passing through said first portion of said hole, one surface of said magnetic field providing means being in contact with said plate, another surface of said magnetic field providing means being level with said attachment surface; and the magnetic attraction between said magnetic field providing means and said plate be greater than the magnetic attraction between said magnetic field providing means and a photopolymer plate attached to said holding device.

It is preferred that any voids in each hole be filled with a filling material.

It is preferred that the heat conductivity of said housing, said magnetic field providing means, said plates and said filling material be substantially equal.

It is preferred that said housing consist of aluminium, said magnetic field providing means be rare earth magnets or bi-metal magnets, said filling material consist of an epoxy resin optionally containing metallic oxides and said plate consist of mild steel. It is further preferred that said magnetic holding device, or a portion thereof, be anodised to increase resistance to wear or corrosion.

It is preferred that said attachment surface be smooth and flat across each of said magnetic regions.

It is preferred that said magnetic regions be distributed substantially uniformly across the attachment surface. Alternatively, said magnetic regions may be uniformly distributed across one portion of the attachment surface, and distributed in higher and/or lower concentrations across other portions of said attachment surface.

SUMMARY OF THE INVENTION

It is preferred that the thickness of the magnetic holding device be 5.05 mm. Alternatively, the thickness of the magnetic holding device may be approximately 2 mm.

It is preferred that said attachment surface further comprise surface markings. It is further preferred that said markings form a grid. It is still further preferred that said markings be engraved or printed on said attachment surface.

There is further disclosed herein a method of making a magnetic holding device, said method comprising the steps of:

forming a plurality of holes within a planar housing;

disposing magnetic field providing means within each hole; and fixing a plate of steel or other ferrous material within each hole, wherein the magnetic attraction between said magnetic field providing means and said plate maintains said magnetic field providing means within its respective hole.

It is preferred that said magnetic field providing means comprise a permanent magnet. Alternatively, said magnetic field providing means may comprise an electromagnet.

It is preferred that said magnetic holding device have an attachment surface, and said plate be fixed on an opposite side of said magnetic field providing means to said attachment surface.

It is preferred that each hole extend through said planar housing. It is further preferred that each hole have a first portion with a first diameter and a second portion with a second diameter greater than said first diameter, said first portion being adjacent said attachment surface.

It is preferred that said method further comprise the step of adding a filling material to each hole to at least partially surround each magnetic field providing means and/or plate. It is further preferred that said filling material fill any voids around said magnetic field providing means and said plate.

It is preferred that said planar housing be disposed on a flat nonmagnetic surface after said step of forming said holes, with said attachment surface adjacent said flat surface.

It is preferred that said step of adding filling material comprise pouring a liquid filler around said magnetic field providing means and said plate, said nonmagnetic surface preventing said liquid filler flowing out of said holes, followed by the step of curing said filler to form a solid.

This invention, in another broad form, provides a method for attaching a steel backed photopolymer plate to foil stamping equipment, said method comprising the steps of:

mounting a magnetic holding device on a heating element of said foil stamping equipment, said magnetic holding device comprising magnetic regions; and further mounting said steel backed photopolymer plate on said magnetic holding device, said steel backed photopolymer plate being attached to said magnetic holding device by the magnetic attraction between said magnetic regions and said steel backed photopolymer plate.

It is preferred that said magnetic holding device be mounted on said heating element by any one of the group consisting of adhesives; adhesive tapes; clips; bolts; similar removable mounting means; and any combination thereof.

Alternatively, said magnetic holding device may be mounted on said heating element by the magnetic attraction between said magnetic holding device and said heating element.

It is preferred that the magnetic attraction of said photopolymer plate to said magnetic regions be weak enough to allow said photopolymer plate to be attached to and removed from said holding device without damaging said photopolymer plate, and be strong enough to secure said photopolymer plate during a foil stamping operation.

BRIEF DESCRIPTION OF THE DRAWINGS

By way of example only, a preferred embodiment of a magnetic holding device according to this invention will now be described with reference to the accompanying drawings, wherein.

DESCRIPTION OF SPECIFIC EMBODIMENTS

Figure 1:
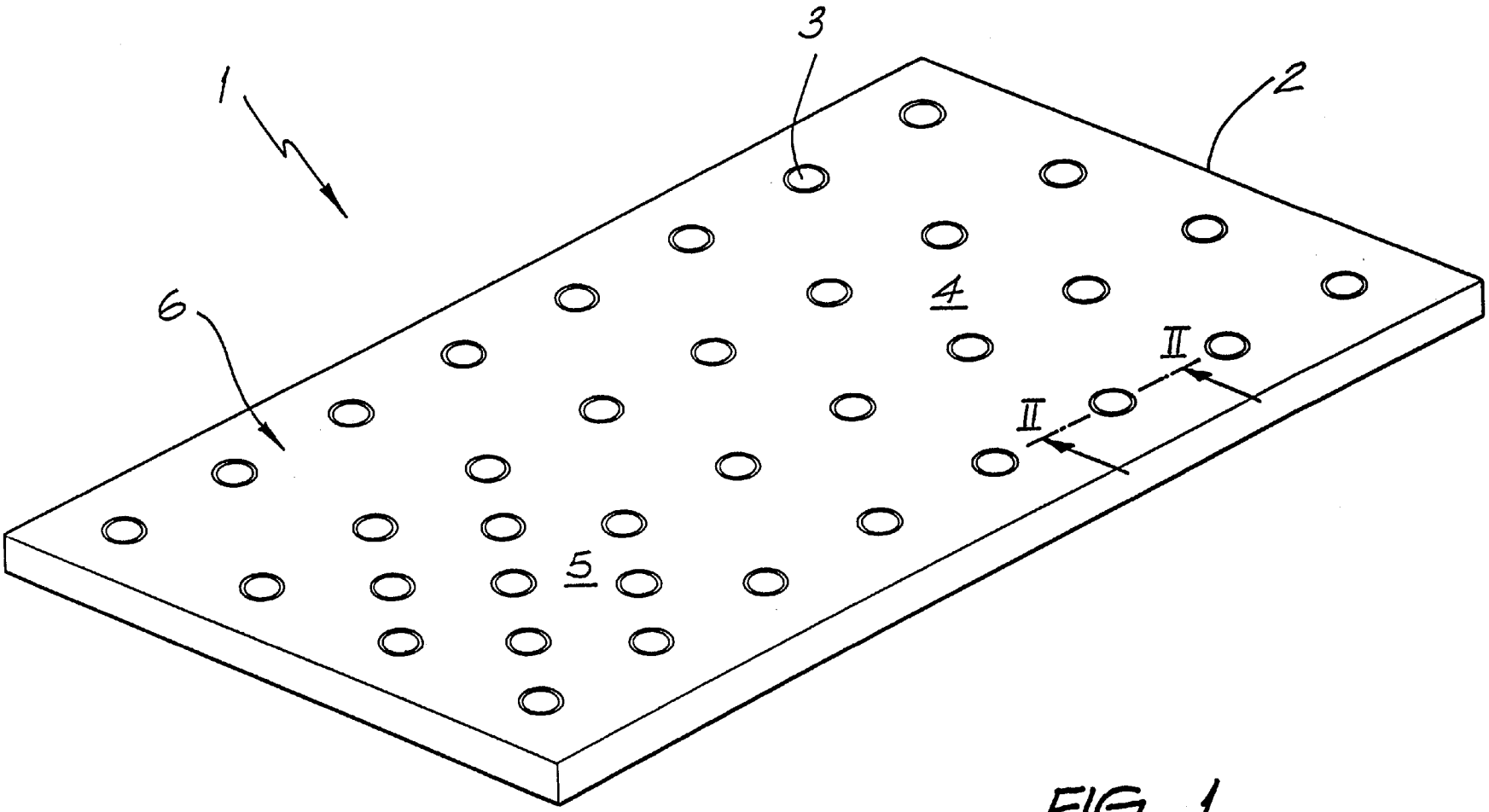
FIG. 1 is a perspective view of a magnetic holding device according to the invention.

FIG. 1 shows a magnetic holding device generally indicated by reference numeral 1. The holding device 1 comprises a thin flat housing 2 with a plurality of magnetic regions 3 therein. The housing 2 can be made of aluminium, steel, brass, copper, alloys of any of the above, or any other incompressible, heat conductive material.

In the embodiment shown, the magnetic regions 3 are distributed uniformly 4 across the majority of the attachment surface 6 of the housing 2, with a small area in which the magnetic regions 3 are more densely distributed 5. The attachment surface 6 of the holding device 1 is that surface to which a steel backed photopolymer plate is to be attached. In other embodiments of the invention, the magnetic regions 3 may be distributed in other patterns to suit specific holding tasks. One use of densely distributed magnetic regions 3 is to provide a relatively strong magnetic field which is suitable for securing small photopolymer plates. Thus smaller plates can be used which saves on photopolymer plate material. Also, the magnetic regions 3 may be distributed sparsely to produce a relatively weak magnetic field, in which photopolymer plates may be more easily attached or removed from the holding device 1. The photopolymer plate can then be slid across the attachment surface 6 to be located within the appropriate magnetic field.

Figure 2:
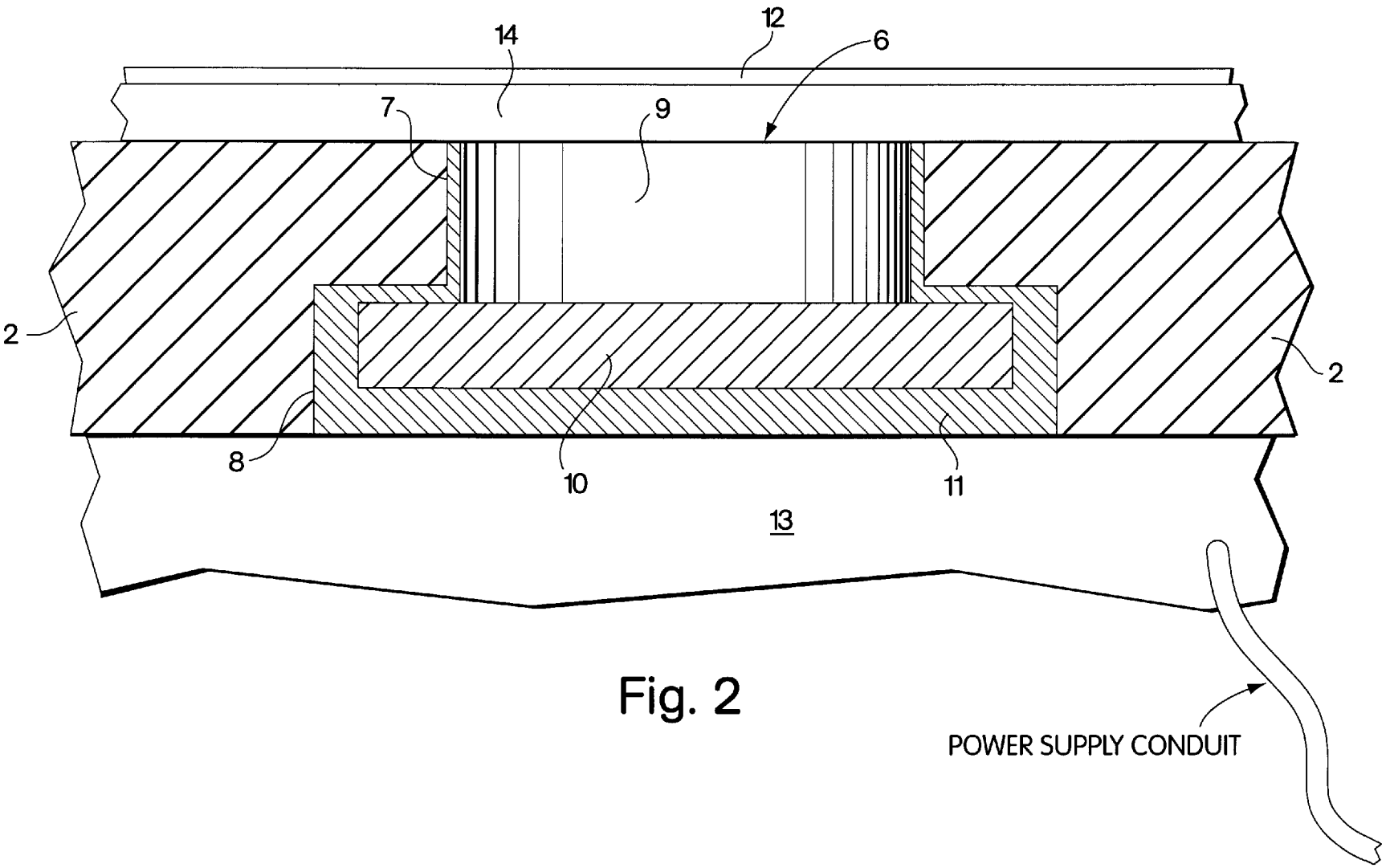
FIG. 2 is a partial sectional view indicated by the arrows II of FIG. 1.

FIG. 2 is a cross sectional view of one of the magnetic regions 3. The housing 2 comprises a hole having a first portion 7 and a second portion 8. A disc magnet 9 is set within the first portion 7 and is flush with the attachment surface 6. A mild steel plate 10, in the shape of a disc, is held against the surface of the magnet 9 due to the magnetic attraction therebetween and stands off from the junction of the first and second portions 7,8. The plate 10 may be made of other materials, so long as the magnetic attraction between the plate 10 and the magnet 9 is greater than the magnetic attraction between the steel backing 14 of the photopolymer plate 12 (shown in phantom) and the magnet 9. As the diameter of the plate 10 is greater than that of the first portion 7, this prevents the magnet 9 being withdrawn from the hole 7 when the photopolymer plate 12 is removed from the magnetic holding device 1.

The strength of the magnetic attraction between the photopolymer plate 12 and the magnet 9 is strong enough to prevent the photopolymer plate 12 moving during a foil stamping operation, but is not so strong as to risk damaging the photopolymer plate 12 when it is attached to the holding device 1. If the attraction is too strong, the photopolymer plate 12 may be pulled from the operator's hand as the plate 12 is brought close to the holding device 1, with the impact of the plate 12 against the holding device 12 possibly damaging the brittle photopolymer. This is also a reason for sparsely distributed magnetic regions, to provide parts of the holding device with low magnetic field strengths, as mentioned above.

A filling material 11, such as an epoxy resin, is used to fill the voids in the first and second portions 7,8. The attachment surface 6 of the holding device 1 is smooth and flat, with the surfaces of the magnet 9 and housing 2 being at the same level. The filling material 11 also ensures that there are no gaps between the housing 2 and magnet 9, as well as helping to retain the magnet 9 within the housing 2. The filling material 11 preferably comprises metals or metallic oxides to increase the heat conductivity of the filling material 11 so that it is similar to that of the housing 2.

The housing 2, magnet 9, place 10 and filling material 11 all have a similar heat conductivity so that heat conducted to the attachment surface 6 is substantially uniform across the attachment surface 6. Poor quality foil stampings can result if the photopolymer plate 12 is not heated uniformly, In addition, the magnetic holding device 1 is constructed from materials which are unaffected by the elevated temperatures encountered during foil stamping.

The holding device 1 is mounted on a heating element 13, shown in phantom, using conventional methods such as adhesives, adhesive tapes, clips or bolts. In some embodiments cases, the magnetic field associated with the magnetic regions may be sufficient to affix the holding device. The holding device 1 need only be mounted once, and need not be removed and remounted each time a photopolymer plate 12 is attached. Another method of mounting the magnetic holding device on the heating element is the use of dog clips which engage the periphery of the magnetic holding device. Such dog clips may bite into the base material of the magnetic holding device to ensure that the device does not move during foil stamping operations.

A further method of securing the magnetic holding device is to bolt it in position, using appropriately countersunk holes in the device. In yet another alternative, projections may be formed on, or added to, the heating element. Then, when the magnetic holding device is placed on the heating element, it will be unable to slide relative to the heating element due to the projections engaging the peripheral edge of the magnetic holding device, or engaging cavities or holes in the rear surface of the device.

The first step of the manufacture of the holding device 1 is the machining of the housing 2 to a predetermined thickness, typically 5.05 mm, although holding devices having a thickness of approximately 2 mm are preferred for some applications. No other machining is then required to the attachment surface 6. Countersunk holes are then machined, producing two portions having different diameters 7,8. The housing 2 is then laid upon a flat, nonmagnetic surface, e.g. polycarbonate sheet, with the larger diameter portion 8 upwards, i.e. inverted compared to the orientation shown in FIG. 2. The disc shaped magnet 9 is then placed within the first portion 7, and the steel plate 10 placed on top of the magnet 9, in the second portion 8. The thickness of the magnet 9 is greater than the depth of the first portion 7 so that the plate 10 is only supported by the magnet 9. The filling material 11 is then poured into the hole to fill the voids, and allowed to cure. The filling material 11 prevents the plate 10 and magnet 9 falling out of the housing 2 whilst It is handled, and also conducts heat from the heating element 13 to the photopolymer plate 12. The holding device 1 thus formed is ready to be used in foil stamping processes.

One preferred form of the magnetic holding device further includes a grid or other markings on the attachment surface of the device. These markings will allow an operator to quickly and accurately align a photopolymer plate on the magnetic holding device. The markings may be engraved or printed on the surface of the device. If printed, the ink would need to be suitable for withstanding the temperatures involved in the stamping operation. Any grid size or other type of marking that will aid the operator can be used.

The magnetic holding device of the present invention may also be used in other situations where a thin ferromagnetic plate needs to be temporarily held without damaging the plate. The magnetic holding device may be used during the manufacture of the photopolymer plate, such as holding the steel backing plate still whilst the photopolymer is being applied to the backing plate. A typical thickness of the holding device for this type of job would be approximately 2 mm.

One advantage of the holding device as described above is that it only needs to be mounted on the heating element once, and the photopolymer plate is mounted by simply placing it in the desired position. The magnetic attraction between the holding device and the steel back of the photopolymer plate holds it in place. Thus attaching the photopolymer plate to the holding device is much quicker than both the method of mounting magnesium plates, and the conventional methods of attaching photopolymer plates, such as using adhesive tapes. In addition, use of the present invention allows the position of photopolymer plates to be readily altered, e.g. in case the plates have been positioned inaccurately. Once a photopolymer plate has been attached using conventional methods, it is time consuming to remove and re-attach the plate, and the chance of damaging the plate is much higher.

An alternative embodiment to that described above involves the use of electromagnets rather than permanent magnets. Electrical power could be supplied to the electromagnets through contacts built into the holding device, such as along the periphery or rear surface of the holding device. The use of electrical contacts along the periphery of the holding device housing would allow this form of the device to be used without altering existing equipment, whilst new foil stamping devices may be designed with appropriate means for energising a holding device built into the heating element.

An advantage of the manufacturing method of the present invention is that the method does not include any steps which involve machining the attachment surface after the holes are formed. A further advantage is that the use of the filling material allows a high quality attachment surface to be produced despite machining variations in the forming of the holes.

It will be appreciated by those skilled in the art that numerous modifications and alterations can be made without departing from the basic inventive concept. All such modifications and alterations are to be considered within the scope of the present invention.

What we claim is:

1. In combination, a magnetic holding device attaching a steel backed photopolymer plate to a foil stamping heating element, said magnetic holding device comprising:

a planar member mounted on said foil stamping heating element, the planar member having a flat attachment surface to engage the plate, said heating element having a power supply conduit to receive electrical power from a power supply; and one or more magnetic regions, each comprising means for providing a magnetic field attached to said planar member, said magnetic regions(s) removably securing said photopolymer plate against said planar member attachment surface;

wherein said planar member and said one or more magnetic regions are heat conductive so as to transfer heat from the heating element for delivery to foil to be stamped.

2. A combination of claim 1, wherein said magnetic field providing means comprises a permanent magnet.

3. A combination of claim 1, wherein each magnetic field providing means is disc shaped and is mounted within a hole.

4. A combination of claim 3, wherein:

each hole has a first portion adjacent said attachment surface with a first diameter and a second portion with a second diameter greater than said first diameter;

a plate of steel or other ferrous material is disposed within said second portion of said hole, the size and shape of said plate preventing said plate passing through said first portion of said hole, one surface of said magnetic field providing means being in contact with said plate, another surface of said magnetic field providing means being level with said attachment surface; and the magnetic attraction between said magnetic field providing means and said plate is greater than the magnetic attraction between said magnetic field providing means and a photopolymer plate attached to said holding device.

5. A combination of claim 3, wherein any voids in each hole are filled with a filling material.

6. A combination of claim 5, wherein said magnetic field providing means, said plate and said filling material are heat conductive so as to provide substantially uniform heat distribution across a surface of the plate.

7. A combination of claim 5, wherein each magnetic field providing means is a rare earth magnet or bi-metal magnet, and said filling material consists of any epoxy resin containing metallic oxides.

8. A combination of claim 1, wherein said magnetic holding device, or a portion thereof, is anodised to increase resistance to wear or corrosion.

9. A combination of claim 1, wherein said attachment surface is smooth and flat across each of said magnetic regions.

10. A combination of claim 1, wherein said magnetic regions are distributed substantially uniformly across the attachment surface.

11. A combination of claim 1, wherein said magnetic regions are uniformly distributed across one portion of the attachment surfaces, and distributed in higher and/or lower concentrations across other portions of said attachment surface.

12. A combination of claim 1, wherein the thickness of the magnetic holding device is 5.05 mm.

13. A combination of claim 1, wherein the thickness of the magnetic holding device is approximately 2 mm.

14. A combination of claim 1, wherein said attachment surface further comprises surface markings.

15. A combination of claim 14, wherein said markings form a grid.

16. A combination of claim 14, wherein said markings are engraved or printed on said attachment surface.

* * * * *